US005203290A

United States Patent [19]

Tsuruta et al.

[11] Patent Number: 5,203,290

[45] Date of Patent: Apr. 20, 1993

[54] INTAKE AND/OR EXHAUST-VALVE TIMING CONTROL SYTEM FOR INTERNAL COMBUSTION ENGINE

[75] Inventors: Seiji Tsuruta; Tamotsu Todo; Hideaki Onishi, all of Kanagawa, Japan

[73] Assignee: Atsugi Unisia Corporation, Atsugi, Japan

[21] Appl. No.: 929,434

[22] Filed: Aug. 14, 1992

[30] Foreign Application Priority Data

Aug. 23, 1991 [JP] Japan ..... 3-066972[U]

[51] Int. Cl.[5] ..... F01L 1/34

[52] U.S. Cl. ..... 123/90.17; 123/90.31; 464/2; 74/508 R

[58] Field of Search ..... 123/90.15, 90.17/90.31; 464/2, 160; 74/567, 568 R

[56] References Cited

U.S. PATENT DOCUMENTS

| | | | |
|---|---|---|---|
| 4,535,731 | 8/1985 | Banfi | 123/90.15 |
| 4,787,345 | 11/1988 | Thoma | 123/90.17 |
| 4,895,113 | 1/1990 | Speier et al. | 123/90.17 |
| 5,012,774 | 5/1991 | Strauber et al. | 123/90.17 |
| 5,088,456 | 2/1992 | Suga | 123/90.17 |
| 5,138,985 | 8/1992 | Szodfridt et al. | 123/90.17 |

*Primary Examiner*—E. Rollins Cross

*Assistant Examiner*—Weilun Lo

*Attorney, Agent, or Firm*—Foley & Lardner

[57] ABSTRACT

A valve timing control system for an internal combustion engine is provided. This system includes a sprocket assembly in driven connection with a crankshaft of the engine, a camshaft assembly disposing cams for opening and closing intake- and/or exhaust valves, and a ring gear assembly functioning as a piston slidably disposed between the sprocket assembly and the camshaft assembly for modifying a phase angle relation between the sprocket assembly and the camshaft assembly. The system further includes first and second pressure chambers for exerting fluid pressure on the ring gear assembly to be displaced over a range of first, second, and third positions which correspond to phase angle relations respectively suitable for low, intermediate, and high engine load levels. The ring gear assembly is responsive to fluid pressures in the first and second pressure chambers both below a threshold valve to be arranged at the first position, responsive to elevation in the fluid pressure in the first pressure chamber above the threshold value to be arranged at the second position, and responsive to elevation in the fluid pressures in the first and second pressure chambers both above the threshold value to be arranged at the third position.

6 Claims, 7 Drawing Sheets

INTAKE AND/OR EXHAUST-VALVE TIMING CONTROL SYTEM FOR INTERNAL COMBUSTION ENGINE

BACKGROUND OF THE INVENTION

1. Field of The Invention

The present invention relates generally to an intake-and/or exhaust-valve timing control system for an internal combustion engine. More particularly, the invention is directed to an intake-and/or exhaust-valve timing control system which serves to modify the intake-and/or exhaust-valve timing quickly in response to variation in engine operation parameters.

2. Description of The Prior Art

U.S. Pat. No. 4,535,731 assigned to Alfa Romeo Auto S.p.A. and U.S. Pat. No. 5,088,456 assigned to the same assignee of this application disclose conventional valve timing control systems for internal combustion engines. The latter system represents an improvement on the former and includes a sprocket mechanically connected to a crankshaft of an internal combustion engine through a timing chain, a camshaft disposing cams for opening and closing intake valves according to rotation of the sprocket, an intermdiate cylindrical gear element engaging between the sprocket and the camshaft, and a driving mechanism serving to vary valve timing. The driving mechanism is responsive to variation in operating parameters of the engine to displace the intermediate cylindrical gear element in an axial direction for modifying a phase angle between the sprocket and the camshaft, advancing or retarding the valve timing of the intake valves.

The driving mechanism includes first and second pressure chambers and a solenoid operated actuator for selectively regulating hydraulic pressures supplied to the first and second pressure chambers. When an engine load is increased to a preselected intermediate level, the hydraulic pressure in the first pressure chamber is elevated and then acts on a movable member provided in the first pressure chamber to be displaced for thrusting the intermediate cylindrical gear element from an initial position to an intermediate position so that the valve timing is changed to timing suitable for the intermediate engine load level. When the engine load is further increased, a hydraulic line is changed from the first pressure chamber to the second pressure chamber to increase the hydraulic pressure in the second pressure chamber while the hydraulic pressure in the first pressure chamber is decreased. The elevated hydraulic pressure in the second pressure chamber acts on both the movable member and the intermediate cylindrical gear element so that the movable member is moved in a direction opposite displacement of the intermediate cylindrical gear element. In other words, part of the elevated hydraulic pressure in the second pressure chamber is consumed in displacing the movable member. Thus, the internal pressure in the second pressure chamber required for displacing the intermediate cylindrical gear element is somewhat reduced momentarily, resulting in a response rate for varying the valve timing being delayed.

SUMMARY OF THE INVENTION

It is therefore a principal object of the present invention to avoid the disadvantages of the prior art.

It is another object of the present invention to provide a valve timing control system for an internal combustion engine which is operable to vary valve timing at a quick response rate according to variation in engine operating parameters.

According to one aspect of the present invention to provide a valve timing control system for an internal combustion engine which comprises a rotary member rotatably connected to a crankshaft of the engine, a camshaft assembly connected to the rotary member rotatably in synchronism with the crankshaft, a piston means disposed between the rotary member and the camshaft assembly, the piston means being displacable over a range of: first, second, and third piston positions, the first piston position being to establish a first phase angle relation between the rotary member and the camshaft assembly, the second piston position being to establish a second phase angle relation where a phase angle between the rotary member and said camshaft assembly is shifted by a first degree from the first phase angle relation, the third piston position being to establish a third phase angle relation where a phase angle between the rotary member and the camshaft assembly is shifted by a second degree greater than the first degree from the first phase angle relation, a sensor means for detecting a preselected engine operating parameter to provide a sensor signal indicative of an engine load level, a fluid power source for providing fluid pressure for valve timing control, a first pressure chamber means fluidly communicating with the fluid power source through a first pressure line, the first pressure chamber means for exerting fluid pressure on the piston means to be displaced from the first piston position to the second piston position, a second pressure chamber means fluidly communicating with the fluid power source through a second pressure line, the second pressure chamber means for exerting hydraulic pressure on the piston means to be displaced from the second piston position to the third piston position, a movable member slidably disposed in the first pressure chamber means, the movable member being responsive to elevation in fluid pressure in the first pressure chamber means to be urged to move the piston means from the first piston position to the second piston position, and a control means responsive to the sensor signal from the sensor means indicating a low engine load level for reducing fluid pressures in the first and second pressure chambers below a preselected level to position the piston means at the first piston position, the control means being responsive to the sensor signal indicating an intermediate engine load level for elevating fluid pressure in the first pressure chamber above the preselected level to urge said movable member to move the piston means to the second piston position from the first piston position, the control means being further responsive to the sensor signal indicating a high engine load level for elevating fluid pressure in the second pressure chamber above the preselected level while maintaining the fluid pressure in the first pressure chamber above the preselected level to move the piston means from the second piston position to the third piston position.

In the preferred mode, the control means includes first and second directional control valves. The first directional control valve selectively establishes fluid communicating between the first pressure line and the fluid power source and between the first pressure line and a drain line. The second directional control valve selectively establishes fluid communication between the second pressure line and the fluid power source and between the second pressure line and the drain line. The control means is responsive to the sensor signal indicative of the low engine load level to provide first control signals to the first and second directional control valves to discharge the fluid pressures in the first and second pressure chambers respectively from the drain line. Additionally, the control means is responsive to the sensor signal indicating the intermediate engine load level to provide a second control signal to the first directional control valve to establish the fluid communication between the first line and the fluid power source while providing the first control signal to the second directional control valve. The control means is further responsive to the sensor signal indicating the high engine load level to provide the second control signal to the second directional control valve to establish the fluid communication between the second pressure line and the fluid power source while providing the second control signal to the first directional control valve.

A single four-port three-positional directional control valve may alternative be utilized in place of the separate two directional control valves.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiments but are for explanation and understanding only.

In the drawings.

DESCRIPTION OF THE PREFERRED EMBODIMENT

Figure 1:
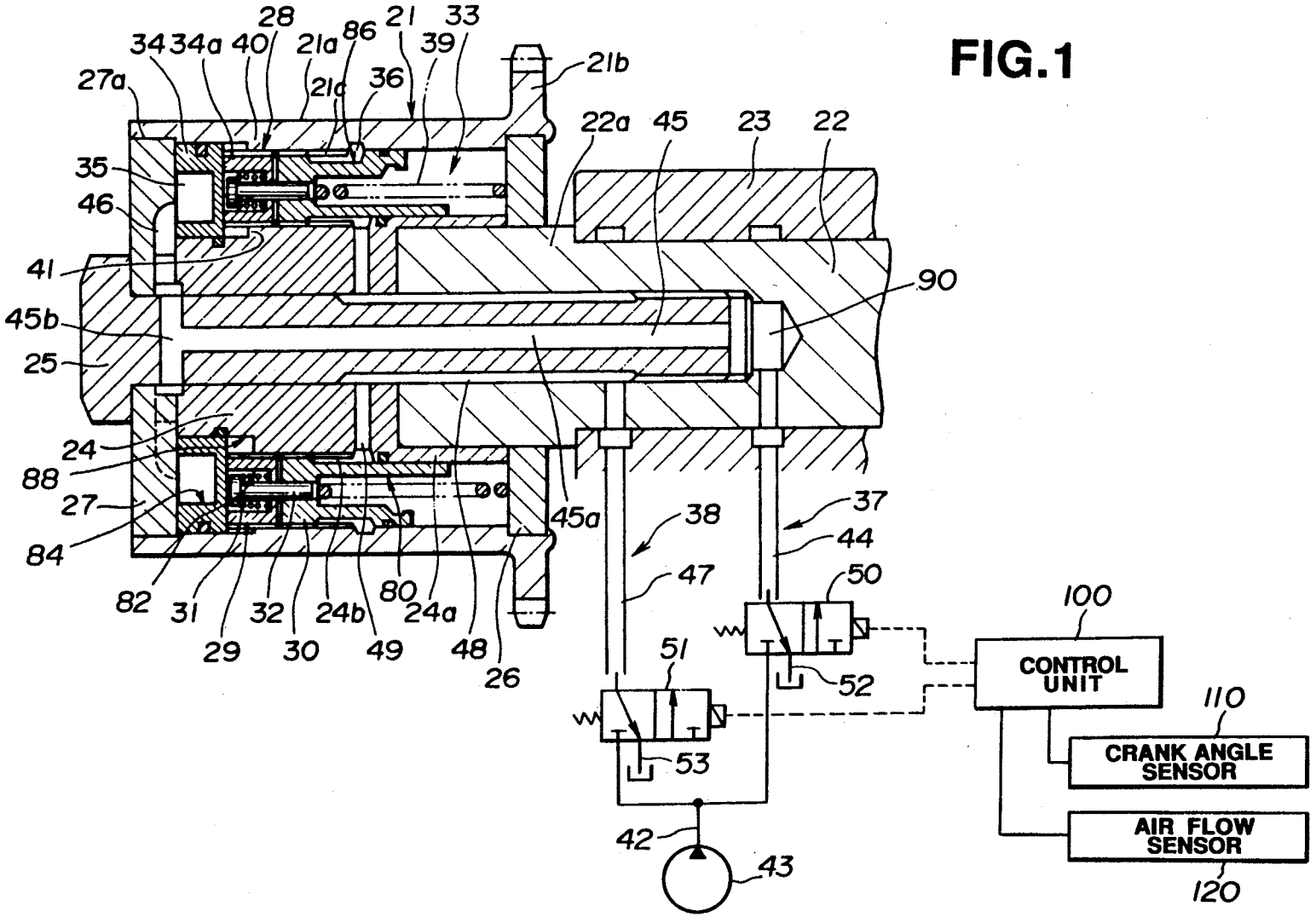
FIG. 1 is a cross-sectional view which shows a valve timing control system according to the present invention.

Referring now to the drawings, particularly to FIG. 1, there is shown a valve timing control system according to the present invention which is suitable for intake valves of an internal combustion engine. Of course, the shown control system may be utilized for controlling exhaust valve timing.

The valve timing control system includes generally a sprocket assembly 21 and a camshaft 22. The sprocket assembly 21 is mechanically connected to an engine crankshaft (not shown) through a timing chain (not shown). The camshaft 22 is journaled by a cam bearing 23 installed on a cylinder head at its end portion **22*a*. Rotation of the crankshaft causes the sprocket assembly 21 to rotate, thereby operating the camshaft 22 in synchronism with the crankshaft to open and close intake valves (not shown) in preselected timing. Attached to the end portion 22*a* of the camshaft 22 in alignment therewith by means of a bolt 25 is a sleeve 24. The sleeve 24 includes a hollow cylindrical end portion 24*a* and an outer gear 24*b*. The hollow cylindrical end portion 24*a* engages the end portion 22*a* of the camshaft 22. The outer gear 24*b* is formed on the central peripheral surface of the sleeve 24**.

The sprocket assembly 21 includes a cylindrical member **21*a*, a gear section 21*b*, a ring member 26, and a front cover 27. The gear section 21*b* is formed integrally with an end portion of the cylindrical member 21*a*. An outer surface of the ring member 26 is fixed onto an inner wall of the gear section 21*b* by caulking, while an inner peripheral surface of the ring member is supported slidably on an outer periphery of the end portion 22*a* of the camshaft 22. The front cover 27 is bolted to an end portion of the sleeve 24 by means of the bolt 25 to enclose an end aperture of the cylindrical member 21*a* so as to allow the cylindrical member 21*a* to rotate slidably relative to the front cover 27. On an inner wall of the central portion of the cylindrical member 21*a*, an inner gear 21*c*** is provided.

Provided between the sleeve 24 and the cylindrical member **21*a* is a ring gear assembly 28 functioning as a piston which is axially displaced by a driving mechanism (as will be described in detail hereinafter). The ring gear assembly 28 includes first and second ring gear elements 29 and 30 separate from each other. The first and second ring gear elements 29 and 30 are formed in such a manner as to cut a single ring gear member transversely into two parts which have annular grooves 80 and 82 each defining an essentially U-shaped longitudinal cross-section. A plurality of holes are formed in the bottoms of the first and second ring gear elements 29 and 30 respectively so as to coincide with each other with tooth traces of the first and second ring gear elements 29 and 30 being offset by a certain degree required for compensating backlash. Connecting pins 32 are press-fitted into the holes of the second ring gear element 30 with coil springs 31 disposed between heads of the connecting pins 32 and the bottom of the first ring gear element respectively so that the first ring gear element 29 is urged into constant engagement with the second ring gear element 30. The first and second ring gear elements 29 and 30 include outer and inner helical gears on their outer and inner surfaces which mesh with the inner gear 21*c* of the cylindrical member 21*a* and the outer gear 24*b* of the sleeve 24 respectively in a spiral fashion. The longitudinal displacement (i.e., in a lateral direction as viewed in the drawing) of the ring gear assembly 28 is allowed within a range from the leftmost position where the first ring gear element 29 is biased into engagement with an inner wall of the front cover 27 via a movable member 34 (as it will be referred to hereinafter), to the rightmost second position where the second ring gear element 30 is urged into contact with an inner wall of the ring member 26**.

The driving mechanism 33 includes the movable member 34 slidable in the axial direction, a first annular pressure chamber 35, a second annular pressure chamber 36, first and second hydraulic circuits 37 and 38 for providing hydraulic pressure to the first and second annular pressure chambers 35 and 36, and a compression coil spring 39. The first annular pressure chamber 35 is defined by the inner wall of the front cover 27 and an annular recessed portion, or groove 84 formed in the movable member 34. The second annular pressure chamber 36 is defined by an annular recessed portion 86 formed in the central portion of a peripheral wall of the second ring gear element 30 and an inner wall of the cylindrical member 21*a* of the sprocket assembly 21. The coil spring 39 is arranged between the annular groove 80 of the second ring gear element 30 and the inner wall of the ring member 26.

The movable member 34 is disposed in an annular cavity 88 which is defined between recessed portions extending circumferentially along an inner wall of the cylindrical member 21*a* and an outer wall of the sleeve 24 respectively. The movable member 34 is biased by a spring force of the coil spring 39 through the first ring gear element 29 into constant engagement with the inner wall of the front cover 27. The elevation in hydraulic pressure in the first annular pressure chamber 35 causes the movable member 34 to be displaced to the right, as viewed in the drawing, against the spring force of the coil spring 39. The maximum permissible displacement of the movable member 35 is defined by shoulder portions 40 and 41 of the annular recessed portions of the cylindrical member 21*a* and the sleeve 24.

The first hydraulic circuit 37 includes generally a first hydraulic line 44, an axial hydraulic line 45, and a first communication line 46. The first hydraulic line 44 communicates with a fluid power source such as an oil pump 43 through a first solenoid operated directional control valve 50 and a hydraulic supply line 42 and extends into the camshaft 22 in fluid communication with a bolt hole 90 through the cylinder head and the cam bearing 23. The axial hydraulic line 45 includes first passage 45*a* which extends longitudinally through the bolt 25 along the center line thereof in fluid communication with the first hydraulic line 46 and a second passage 45*b* extending perpendicularly to the first passage 45*a* adjacent a bolt head. The first communication line 46 is provided with a cut-out portions formed in the inner wall of the front cover 27 which communicates between the first annular pressure chamber 35 and the axial hydraulic line 45.

The second hydraulic circuit 38 includes a second hydraulic line 47, an annular line 48, and a second communication line 49. The second hydraulic line 47 extends parallel to the first hydraulic line 44 and is connected to the oil pump 43 through a second solenoid operated directional control valve 51. The annular line 48 is defined by an annular recessed portion formed in an outer surface of the bolt 25 and the inner wall of the bolt hole 90 and communicates with the second hydraulic line 47. The second communication line 49 extends transversely through the sleeve 24 across the bolt hole 90 for establishing fluid communication with the second annular pressure chamber 36.

Each of the first and second solenoid operated directional control valves 51 and 52 is designed as a three-port two-position solenoid operated valve. The first and second directional control valves 51 and 52 are responsive to control signals output from a control unit 100 to selectively establish fluid communication between the oil pump 43 and the first and second hydraulic lines 44 and 47 or between the first and second hydraulic lines 44 and 47 and drain lines 52 and 53 respectively. The control unit 100 includes a microcomputer which serves to monitor engine operating parameters such as engine load based on sensor signals from various sensors such as a crank angle sensor 110 detecting engine speed and an air flow sensor 120 detecting an flow rate of intake air into the internal combustion engine, and provides control signals to the directional control valves 51 and 52 respectively.

In operation, when engine speed, or engine load is lower than a first threshold level, the control unit 100 provides OFF-signals to the first and second directional control valves 50 and 51 respectively to be turned off based on sensor signals from the crank angle and air flow sensors 110 and 120. The directional control valves 50 and 51 then block the fluid communication between the oil pump 43 and first and second hydraulic lines 44 and 47 and establish the fluid communication between the first and second hydraulic lines 44 and 47 and the drain lines 52 and 53 respectively. Thus, the hydraulic fluids in the first and second annular pressure chambers 35 and 36 are discharged from the drain lines 52 and 53, thereby reducing hydraulic pressures in the first and second annular pressure chambers 35 and 36 below a preselected level. This causes the ring gear assembly 28 to be biased by the spring force of the coil spring 39 into engagement with the inner wall of the front cover 27 through the movable member 34. Thus, the camshaft 22 rotates relative to the sprocket assembly 21 in a given direction with a maximum retarded phase angle relation wherein intake valve close timing is retarded most.

Figure 2:
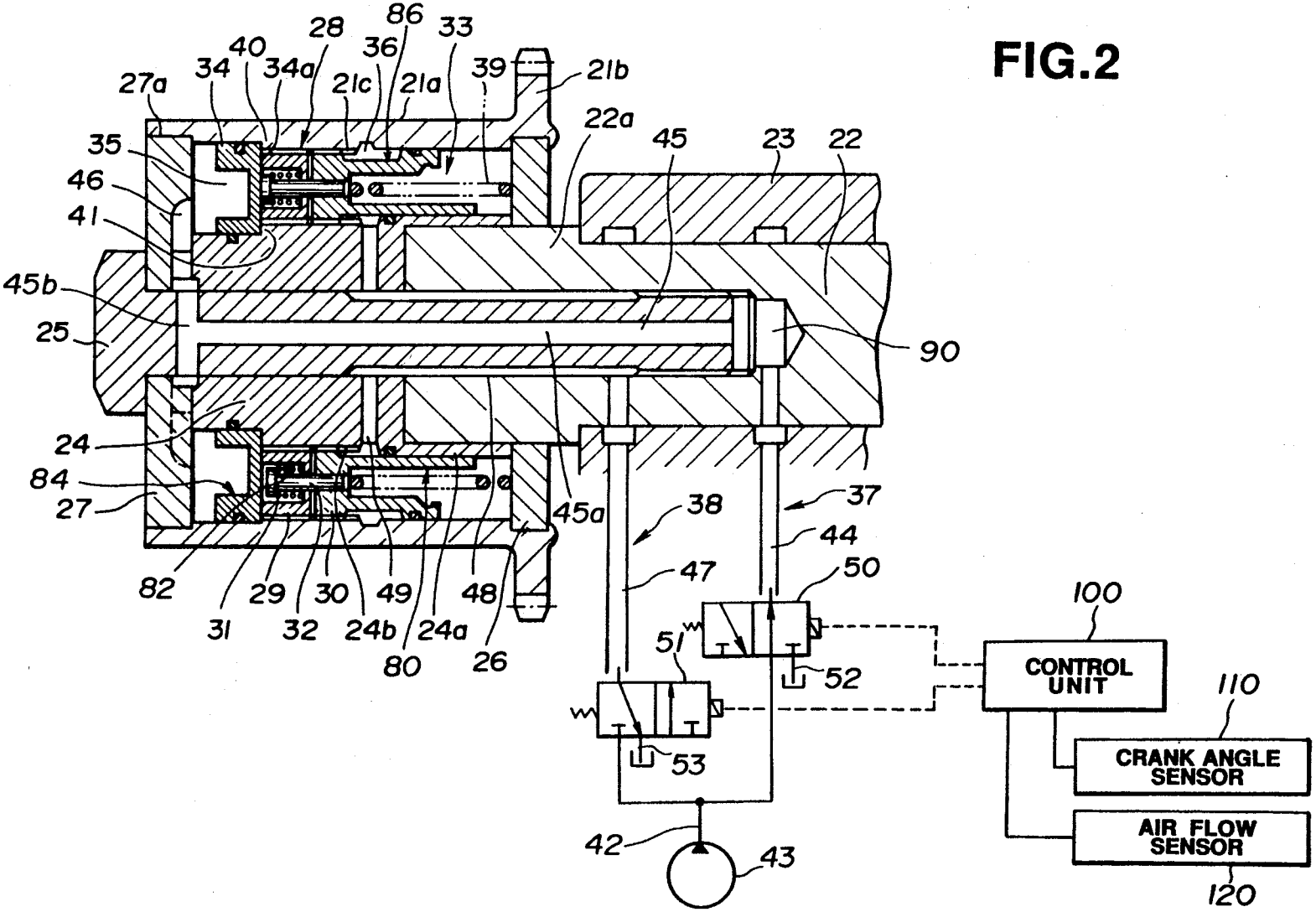
FIG. 2 is an explanatory view which shows the system operation when an engine load is an intermediate level.

When the engine load is increased, by accelerating operation by a driver, toward an intermediate range from the first threshold level to a second threshold level greater than the first threshold level, the control unit 100, as shown in FIG. 2, provides an ON-signal to the first directional control valve 50 to establish the fluid communication between the first hydraulic line 44 and the hydraulic supply line 42 while providing the OFF-signal to the second directional control valve 51 to block the fluid communication between the second hydraulic line 47 and the hydraulic supply line 42. Therefore, the pressurized working fluid is supplied from the oil pump 43 to the first annular pressure chamber 35 through the first hydraulic line 44, the axial hydraulic line 45, and the first communication line 46, increasing the internal pressure of the first annular pressure chamber 35 toward a preselected line pressure defined by the discharge pressure of the oil pump 43. With the elevated pressure in the first annular pressure chamber 35, the movable member 34 and the ring gear assembly 28 are biased toward the ring member 26 against the spring force of the coil spring 39 until the movable member 34 contacts the shoulder portions 40 and 41. This results in the ring gear assembly 28 being maintained at an intermediate position where the phase angle between the sprocket assembly 21 and the camshaft 22 is advanced by a preselected degree for providing the optimal intake valve timing under the intermediate engine load.

Figure 3:
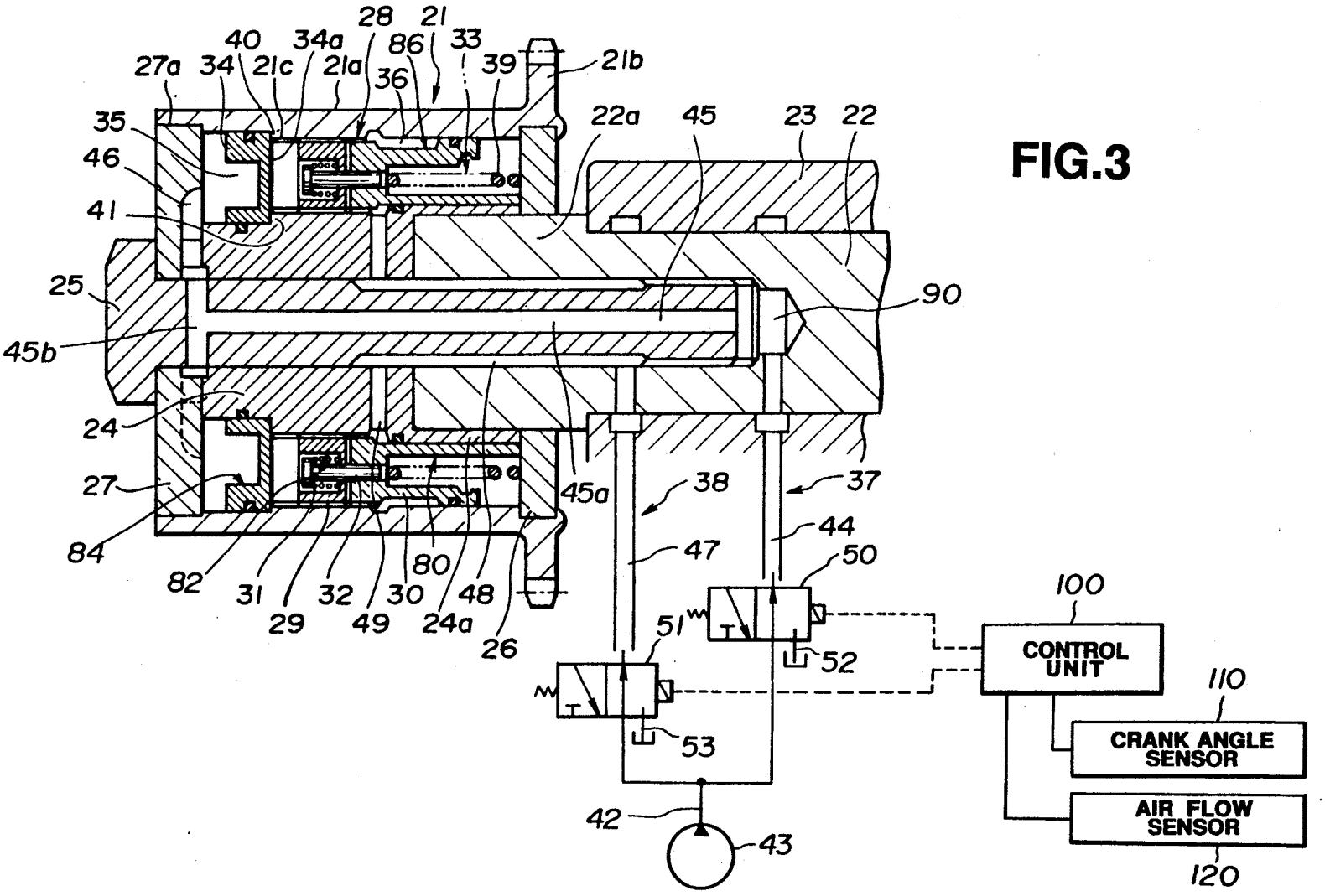
FIG. 3 is an explanatory view which shows the system operation when an engine load is a high level.

When the engine load is further increased toward a level higher than the second threshold level of the intermediate range, the control unit 100, as shown in FIG. 3, provides an ON-signal to the second directional control valve 51 to establish the fluid communication between the second hydraulic line 47 and the hydraulic supply line 42 while providing the ON-signal to the first directional control valve 50. Therefore, the pressurized working fluid is supplied from the oil pump 43 to the second annular pressure chamber 36 as well as the first annular pressure chamber 35 through the first and second hydraulic circuits 37 and 38. This causes pressure in the second annular pressure chamber 36 to be elevated quickly toward the line pressure. As can be seen in the drawings, the right side wall of the second annular pressure chamber 36 on which the internal pressure therein acts is greater in area than the left side wall, therefore, the elevated pressure in the second annular pressure chamber acts on the right side wall more than on the left side wall with the result that the ring gear assembly is further urged to the right speedily until the second ring gear element 30 contacts the ring member 26. Accordingly, the phase angle between the sprocket assembly 21 and the camshaft 22 is further shifted for advancing the intake valve timing.

As mentioned previously, when the engine operation is varied from an intermediate load to a high load, the pressurized working fluid is supplied to the second annular pressure chamber 36 while the pressure in the first annular pressure chamber 35 is held at a high level. Therefore, pressure in the second annular pressure chamber 36 is increased quickly toward a level required for displacing the ring gear assembly 28 for the valve timing adjustment.

When the engine load is varied from the high level to the intermediate level, the control unit 100 provides an OFF-signal to the second directional control valve 51 while energizing the first directional control valve. The hydraulic pressure in the second annular pressure chamber 36 is then discharged from the drain line 53, causing the ring gear assembly 28 to be moved quickly to the intermediate position as shown in FIG. 2.

When the engine load is further decreased to the low level, the first directional control valve 50 is also deenergized to reduce the pressure in the first annular pressure chamber 35 toward approximately zero, thereby causing the ring gear assembly 28 to be urged right until the first ring gear element 29 contacts with the front cover 27 completely.

Figure 4:
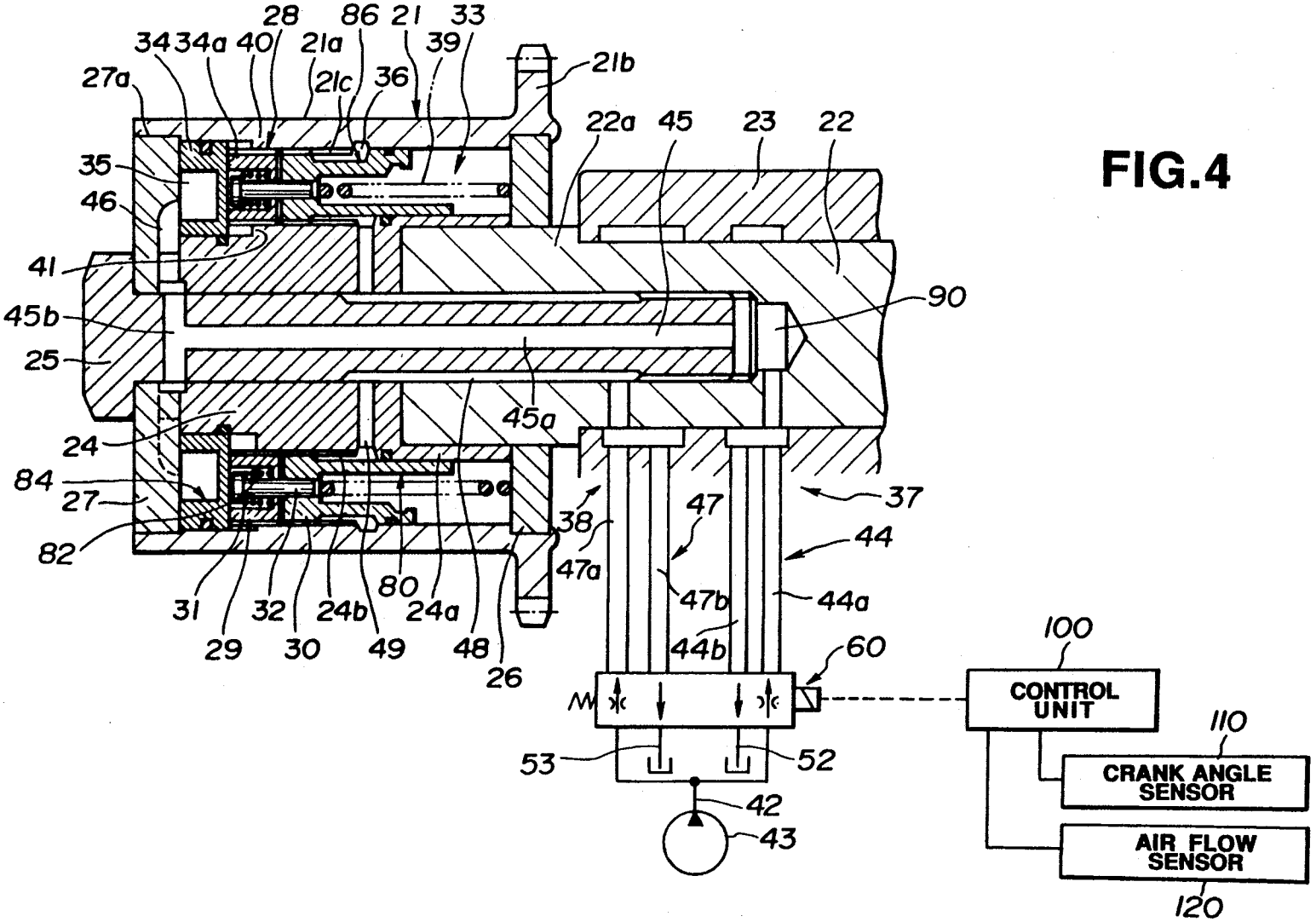
FIG. 4 is a cross-sectional view which shows an alternative embodiment of a valve timing control system according to the present invention.
Figure 5:
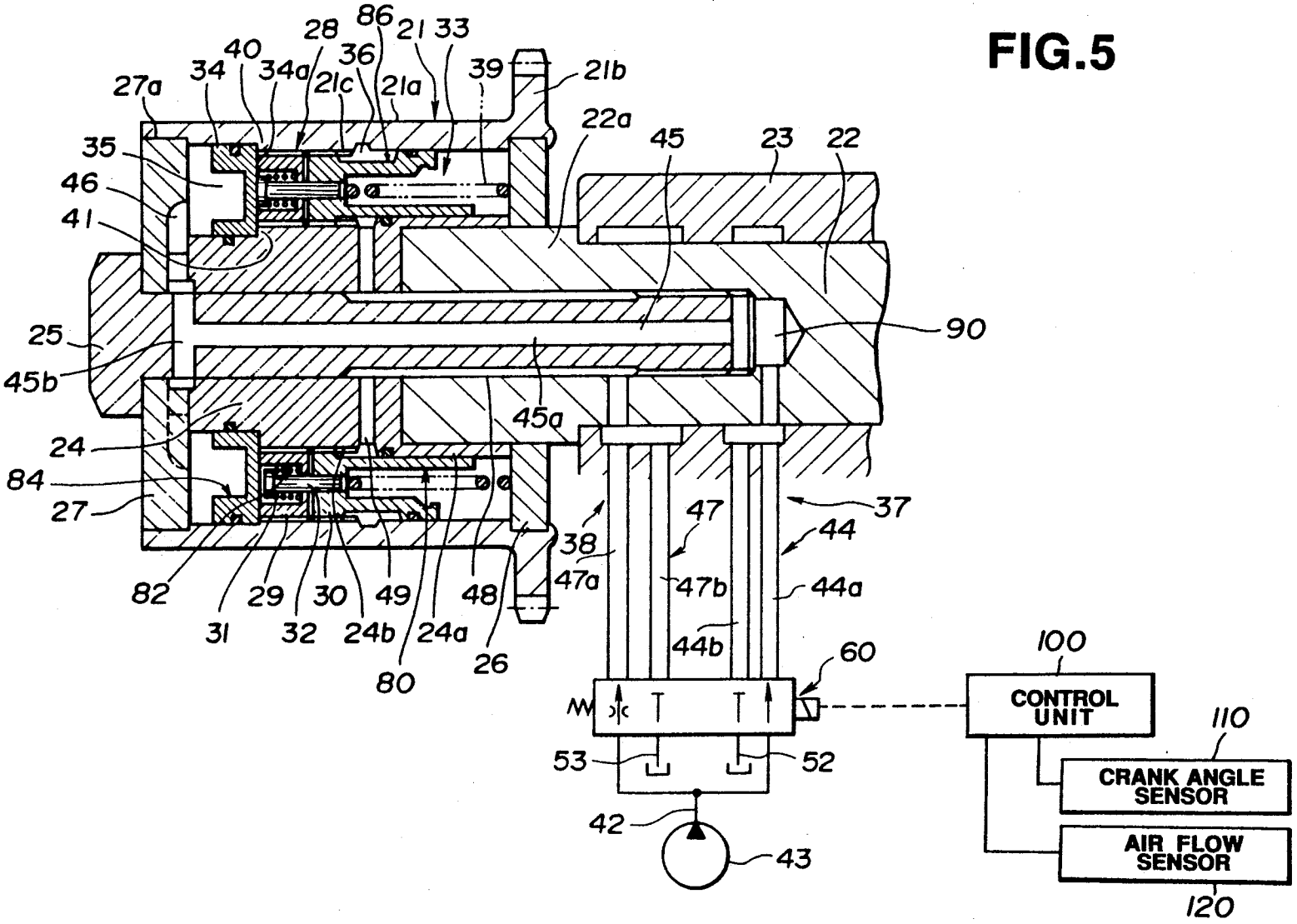
FIG. 5 is an explanatory view which shows the system operation when an engine load is an intermediate level.
Figure 6:
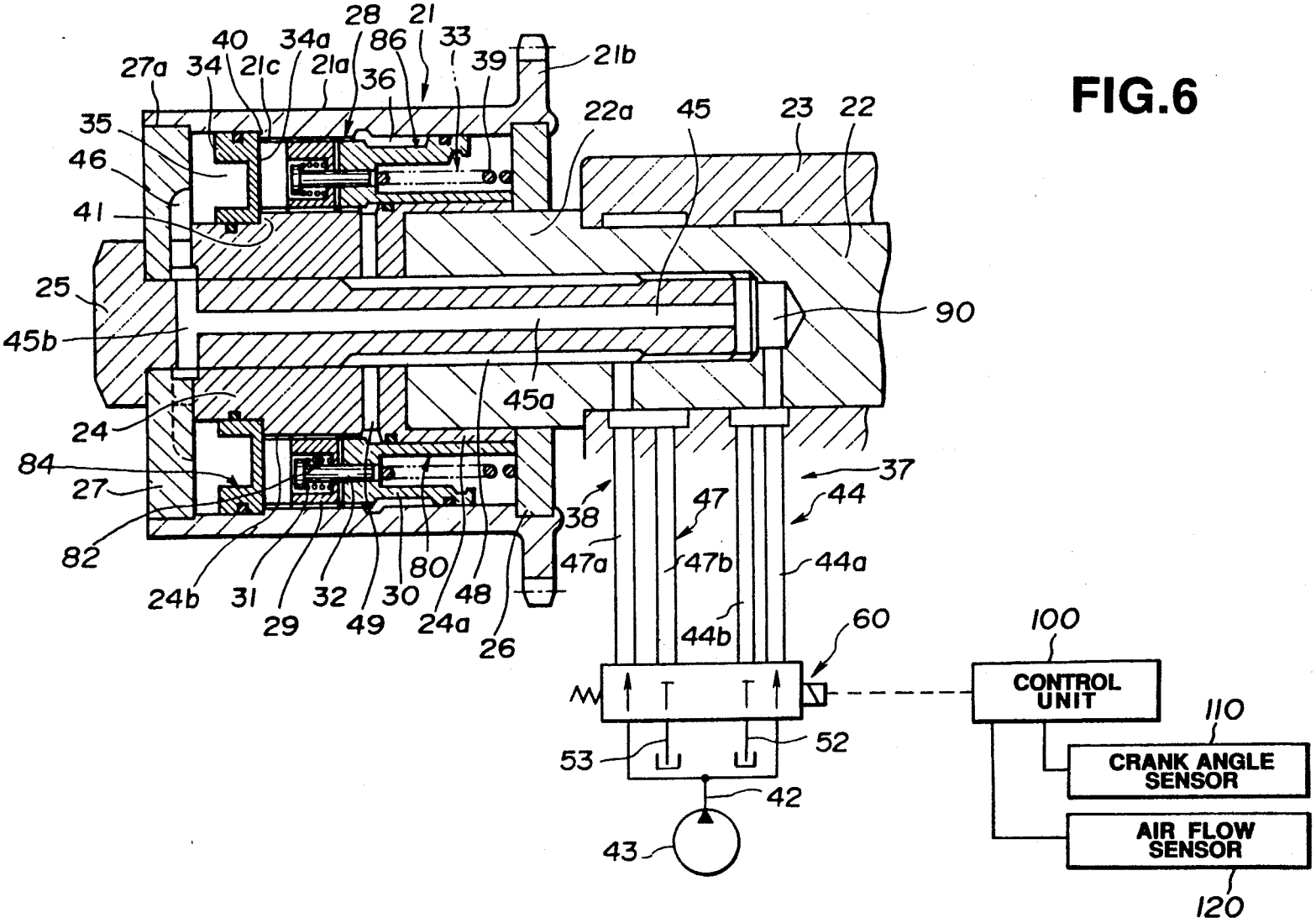
FIG. 6 is an explanatory view which shows the system operation when an engine load is a high level.

Referring to FIGS. 4 to 6, there is shown an alternative embodiment of the present invention. The like reference numbers refer to like parts in FIGS. 1 to 3 and explanation thereof will be omitted in detail.

The valve timing control system of this embodiment is different from the above first embodiment in that a single solenoid operated directional control valve 60 is provided and first and second hydraulic lines 44 and 47 include supply lines **44*a* and 47*a* and drain lines 44*b* and 47*b*** respectively.

Figure 7:
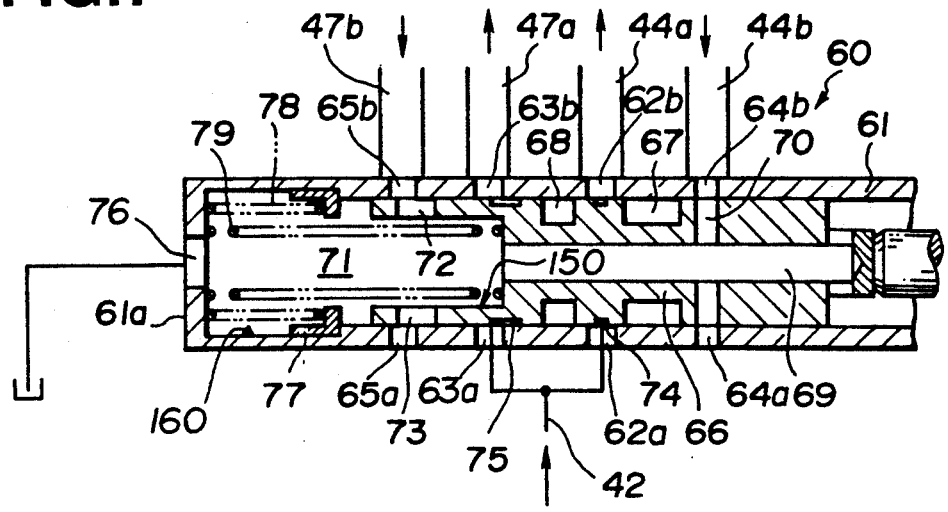
FIG. 7 is a cross-sectional view which shows a solenoid operated directional control valve utilized for controlling hydraulic pressure in a valve timing control system of a second embodiment.
Figure 8:
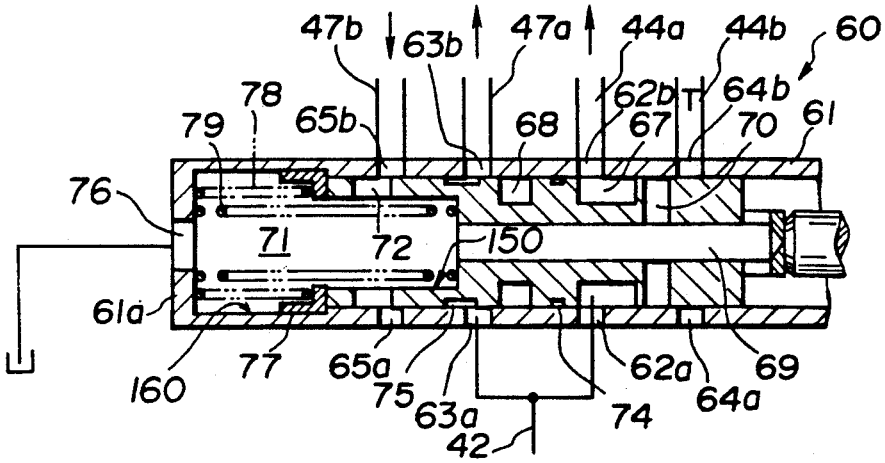
FIG. 8 is an explanatory view which shows the valve operation when an engine load is an intermediate level.
Figure 9:
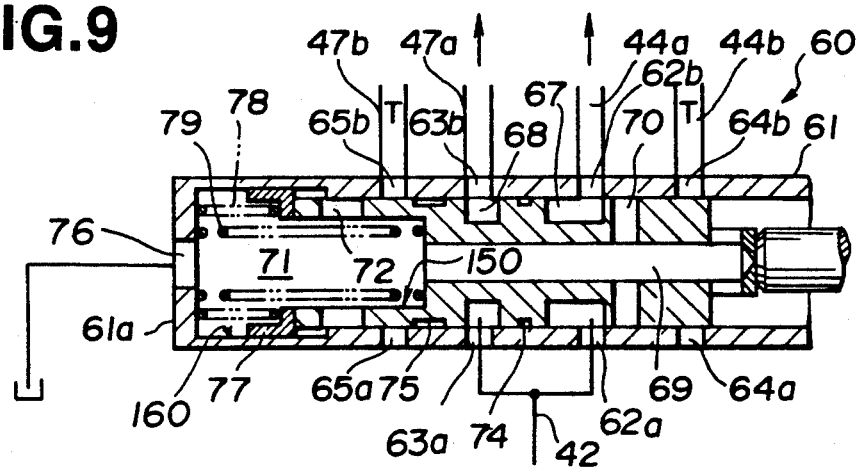
FIG. 9 is an explanatory view which shows the valve operation when an engine load is a high level.

Referring to FIGS. 7 to 9, the solenoid operated directional control valve 60 is shown which is designed as a four-port three-position directional control valve. This valve includes generally a valve housing 61 and a spool valve 66. The valve housing 61 includes inlet ports **62*a* and 63*a*, outlet ports 62*b* and 63*b*, and drain ports 64*a*, 64*b*, 65*a*, and 65*b* in its peripheral surface in the illustrated manner. The spool valve 66 is disposed in the valve housing 61** slidably in an axial direction for selectively establishing fluid communication between the ports.

The spool valve 66 includes annular grooves, 67 and 68 and a through hole 70. The annular grooves 67 and 68 are arranged in the central portion thereof for selectively communicating between upstream and downstream lines of the first and second hydraulic lines 44 and 47. The through hole 70 communicates with the drain ports **64*a* and 64*h* and also communicates with a spool bore 69 which extends along the spool axis. In an end of the spool valve 66, a bore 150 is formed which has an opening oriented to a drain chamber 71 defined in an end portion of the valve housing 61. The bore 150 selectively communicates with the drain ports 65*a* and 65*b* through bores 72 and 73 formed in a cylindrical wall defining the bore 150. Formed in lands between the annular grooves 67 and 68 and between the annular groove 68 and the bores 72 and 73 are annular recessed portions 74 and 75 functioning as restrictors. A drain hole 76 is formed in the central portion of an end wall 61*a* of the valve housing 61 for discharging the hydraulic fluid in the drain chamber 71. Additionally, coil spring 79 is disposed between the bore 150 of the spool valve 66 and the end wall 61*a* of the valve housing 61 for constantly biasing the spool valve 66 toward a position as shown in FIG. 7. A spring retainer 77 is arranged slidably in a large diameter end section 160 of the valve housing 61 which functions as a stopper (it will be referred to hereinafter). A coil spring 78 is placed between the end wall 61*a* of the valve housing 61 and the spring retainer 77 for biasing the spring retainer 77 toward the end of the large diameter section 160** with a preselected spring force.

In operation, when an engine load is a low level, the control unit 100 provides an OFF-signal to the solenoid operated directional control valve 60 to be deenergized for maintaining the spool valve 66 at the rightmost position as viewed in FIG. 7. Therefore, hydraulic pressures in the first and second annular pressure chambers 35 and 36 are discharged from the drain lines **44*b* and 47*b* through the drain ports 64*a*, 64*b*, 65*a*, and 65*b*. Additionally, part of the hydraulic fluid passing through the through hole 70 is introduced to the drain chamber 71 through the spool bore 69 and in turn discharged from the drain hole 76. Further, part of the hydraulic fluid entering into the drain chamber 71 from the drain port 65*b* is also discharged from the drain hole 76. It will be appreciated that the hydraulic pressures in the first and second annular pressure chambers 35 and 36** are reduced to a preselected level quickly.

The hydraulic fluids supplied to the inlet ports **62*a* and 63*a* through the supply line 42 are restricted in pressure by the restrictors 74 ad 75 and then directed to the first and second annular pressure chambers 35 and 36 from the outlet ports 62*b* and 63*b* through the supply lines 44*a* and 47*a*** for use in lubricating sliding parts of the system.

Accordingly, with the reduced pressures in the first and second annular pressure chambers 35 and 36, the ring gear assembly is urged to the leftmost position, as shown in FIG. 4, wherein intake valve close timing is retarded most in the same manner as the first embodiment.

When the engine load is increased into the intermediate load range, the control unit 100 provides a first control signal to the directional control valve 60 to be energized. The spool valve 66 is then biased to the left against the spring force of the coil spring 79 and stops at an intermediate position, as shown in FIG. 8, engaging the spring retainer 77. With this operation, the annular groove 67 of the spool valve 66 establishes fluid communication between the inlet and outlet ports **61*a* and 62*b* so that the hydraulic pressure is supplied from the oil pump 43 to the first annular pressure chamber 35 while the second annular pressure chamber 36 communicates with the supply line 42 through the restrictor 75. Additionally, the drain line 47*b* communicates with the drain chamber 71 through the drain ports 65b and the drain line 44b** is blocked.

As a result, the hydraulic pressure in the first annular pressure chamber 35 is increased, while the hydraulic pressure in the second annular pressure chamber 36 is decreased. Thus, the ring gear assembly 28 is, as shown in FIG. 5, displaced by the movable member 34 toward the intermediate position against the spring force of the coil spring 39.

When the engine load is further increased to the high level, the control unit 100 provides a second control signal, greater in signal level than the first control signal, to the directional control valve 60 so that the spool valve 66 is, as shown in FIG. 9, further displaced to the left against the spring forces of both the coil springs 78 and 79. The spool valve 66 then stops at a position where the spring forces of the coil springs 78 ad 79 is balanced with an operational force acting on the spool valve 66 provided by activity of a solenoid to block the first and second drain lines 44b and 47b and establishes the fluid communication between the first supply line 47a and the supply line 42 through the annular groove 68 in addition to the fluid communication between the first supply line 44a and the supply line 42. Therefore, the hydraulic pressure in the second annular pressure chamber 36 is elevated to a high level with the hydraulic pressure in the first annular pressure chamber 11 being maintained at the high level, thereby biasing the ring gear assembly 28 to the rightmost position, as shown in FIG. 6, wherein an phase angle between the sprocket assembly 21 and the camshaft 22 is modified for securing intake valve timing suitable for the engine operation at a high speed.

As can bee seen in the first and second embodiments, the directional control valves 50, 51, and 60 may be mounted on the outside of the engine or the inside thereof. Accordingly, the overall length of the system in an axial direction is shortened as compared with a conventional valve timing control system as discussed in the introduction of this specification. This results in a greatly improved degree of freedom of system layout in an engine compartment.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A valve timing control system for an internal combustion engine comprising:

a rotary member rotatably connected to a crankshaft of the engine;

a camshaft assembly connected to said rotary member rotatably in synchronism with the crankshaft;

piston means disposed between said rotary member and said camshaft assembly, said piston means being displaceable over a range of first, second, and third piston positions, the first piston position being to establish a first phase angle relation between said rotary member and said camshaft assembly, the second piston position being to establish a second phase angle relation where a phase angle between said rotary member and said camshaft assembly is shifted by a first degree from the first phase angle relation, the third piston position being to establish a third phase angle relation where a phase angle between said rotary member and said camshaft assembly is shifted by a second degree greater than the first degree from the first phase angle relation;

sensor means for detecting a preselected engine operating parameter to provide a sensor signal indicative of an engine load level;

a fluid power source for providing fluid pressure for valve timing control;

first pressure chamber means fluidly communicating with said fluid power source through a first pressure line, said first pressure chamber means for exerting fluid pressure on said piston means to be displaced from the first piston position to the second piston position;

second pressure chamber means fluidly communicating with said fluid power source through a second pressure line, said second pressure chamber means for exerting hydraulic pressure on said piston means to be displaced from the second piston position to the third piston position;

a movable member slidably disposed in said first pressure chamber means, said movable member being responsive to elevation in fluid pressure in said first pressure chamber means to be urged to move said piston means from the first piston position to the second piston position; and control means responsive to the sensor signal from said sensor means indicating a low engine load level for reducing fluid pressures in said first and second pressure chambers below a preselected level to position said piston means at the first piston position, said control means being responsive to the sensor signal indicating an intermediate engine load level for elevating fluid pressure in said first pressure chamber above the preselected level to urge said movable member to move said piston means to the second piston position from the first piston position, said control means being further responsive to the sensor signal indicating a high engine load level for elevating fluid pressure in said second pressure chamber above the preselected level while maintaining the fluid pressure in said first pressure chamber above the preselected level to move said piston means from the second piston position to the third piston position.

2. A system as set forth in claim 1, wherein said control means includes first and second directional control valves, the first directional control valve selectively establishing fluid communication between the first pressure line and said fluid power source and between the first pressure line and a drain line, the second directional control valve selectively establishing fluid communication between the second pressure line and said fluid power source and between the second pressure line and the drain line, said control means being responsive to the sensor signal indicative of the low engine load level to provide first control signals to said first and second directional control valves to discharge the fluid pressures in the first and second pressure chambers respectively from the drain line, said control means being responsive to the sensor signal indicating the intermediate engine load level to provide a second control signal to said first directional control valve to establish the fluid communication between the first line and the fluid power source while providing the first control signal to the second directional control valve, said control means being further responsive to the sensor signal indicating the high engine load level to provide the second control signal to the second directional control valve to establish the fluid communication between the second pressure line and the fluid power source while providing the second control signal to the first directional control valve.

3. A system as set forth in claim 2, wherein said first pressure chamber is defined between said rotary member and said camshaft assembly and oriented to an end of the piston means, said second pressure chamber being defined between a recessed portion formed in the piston means and said rotary member.

4. A system as set forth in claim 3, wherein said piston means includes a ring gear assembly having helical gears on an outer and inner surfaces thereof which mesh with gears formed on said rotary member and said camshaft assembly respectively, the ring gear assembly being responsive to elevation in the fluid pressures in the first and second pressure chambers to be displaced over the range of the first, second, and third piston positions for modifying a phase angle between said rotary member and said camshaft assembly.

5. A system as set forth in claim 1, wherein said control means includes a directional control valve which is disposed between said fluid power source and the first and second pressure lines and has a spool valve slidably within a range of first, second, and third spool valve positions, the first spool valve position being to establish fluid communication between the first and second pressure lines and the drain line, the second spool valve position being to establish fluid communication between the first pressure line and said fluid power source and between the second pressure line and the drain line, the third spool valve position being to establish fluid communication between the first and second pressure lines and said fluid power source, said control means being responsive to the sensor signal indicative of the low engine load level to provide a first control signal to said directional control valve for arranging the spool valve at the first spool valve position, said control means being responsive to the sensor signal indicating the intermediate engine load level to provide a second control signal to said directional control valve to arrange the spool valve at the second spool valve position, said control means being further responsive to the sensor signal indicating the high engine load level to provide a third control signal to said directional control valve to arrange the spool valve at the third spool valve position.

6. A system as set forth in claim 5, wherein said spool valve has a restrictor, said spool valve providing fluid pressure reduced in level by the restrictor to the first and second pressure lines at the first spool valve position and to the second line at the second spool valve position.

* * * * *